United States Patent [19]

Lipscomb

[11] 4,076,267

[45] Feb. 28, 1978

[54] ARTICULATED SKATEBOARD

[76] Inventor: Willis Leonard Lipscomb, 2208 Willow St., San Diego, Calif. 92106

[21] Appl. No.: 724,660

[22] Filed: Sep. 20, 1976

[51] Int. Cl.[2] ..... A63C 17/00

[52] U.S. Cl. ..... 280/87.04 A; 280/7.12; 280/400

[58] Field of Search ..... 280/87.04 A, 87.04 R, 280/87.01, 87.02, 87.03, 11.1 R, 11.19, 11.1 BT, 400, 442, 111, 16, 21, 11.28, 11.27

[56] References Cited

U.S. PATENT DOCUMENTS

| | | | |
|---|---|---|---|
| 1,056,357 | 3/1913 | Murdock | 280/87.04 R |
| 1,453,153 | 4/1923 | Marciniak | 280/16 |
| 2,027,254 | 1/1936 | Vogt | 280/87.04 R |
| 2,366,166 | 1/1945 | Willock | 280/112 R |
| 2,539,360 | 1/1951 | Bartlett | 280/111 |
| 3,226,130 | 12/1965 | Smith | 280/11.28 |
| 3,309,104 | 3/1967 | Gold | 280/87.04 R |
| 3,891,225 | 6/1975 | Sessa | 280/87.04 R |
| 3,982,766 | 9/1976 | Budge | 280/87.04 A |

FOREIGN PATENT DOCUMENTS

| | | | |
|---|---|---|---|
| 1,166,219 | 10/1969 | United Kingdom | 280/111 |

OTHER PUBLICATIONS

"New From Roller Sports," Skateboarder Magazine, Aug. 1976, p. 3.

*Primary Examiner*—David M. Mitchell
*Attorney, Agent, or Firm*—Brown & Martin

[57] ABSTRACT

A skateboard which is divided into front and rear sections each having a wheeled truck, the two sections being interconnected on a longitudinal pivotal axis. With one foot on each section, the rider can tilt the sections independently for very rapid turning and maneuvering with a minimum of body lean. The articulated board is adaptable to conventional skateboard trucks with resiliently mounted wheels, castered wheels, or ice skate type blades. In an enlarged form, the board can be used with the rider in prone or kneeling position, using handlebars on one section of the board for tilt control.

4 Claims, 7 Drawing Figures

ARTICULATED SKATEBOARD

BACKGROUND OF THE INVENTION

Conventional skateboards are steered by the rider leaning to one side or the other to tilt the board, the wheels being pivoted on an inclined axis to provide a turning action when the board is tilted. Variations of the board have been developed to assist the rider, such as an upright control post for support in the manner of a scooter. Dual boards have also been pivotally coupled in the manner of large roller skates. In all of these forms the primary steering action is accomplished by body lean, or at least offsetting both legs relative to the body. When making repeated directional changes, considerable practice is required to avoid over control and loss of balance.

SUMMARY OF THE INVENTION

The skateboard described herein is divided transversely into front and rear sections, which are joined by a pivotal connection having a longitudinal pivotal axis. The two ends of the skateboard can thus be laterally tilted independently by the rider's feet to obtain steering action without undesirable body lean. The rider can lean to compensate for centrifugal force in a turn, but does not need to unbalance his body to initiate a turn.

The pivotal axis may be spaced below the board or be substantially in the plane of the board, and the division may be at the center or closer to one end of the board. In its basic form the skateboard uses conventional wheeled trucks with resilient, inclined axis wheel mountings. However, one end of the board may be fitted with a free castering wheel if desired. In another form the board may be mounted on ice skate blades. In an enlarged configuration the board can be operated with the rider in prone or kneeling position. In this form, foldable handlebars are provided at the forward end of the board to facilitate tilt control.

The primary object of this invention, therefore, is to provide a new and improved articulated skateboard.

Another object of this invention is to provide an articulated skateboard divided into two sections coupled by a longitudinally axial pivotal connection.

A further object of this invention is to provide an articulated skateboard adaptable to a variety of wheel and skate type supports and various riding positions.

Other objects and advantages will be apparent in the following detailed description, taken in conjunction with the accompanying drawing, in which.

DESCRIPTION OF THE PREFERRED EMBODIMENTS

Figure 1:
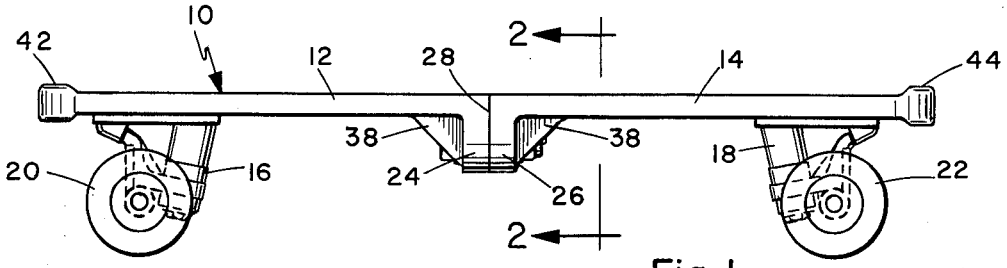
FIG. 1 is a side elevation view of the basic articulated skateboard.

In the basic configuration illustrated in FIGS. 1 through 4, the skateboard 10 is composed of a front section 12 and a rear section 14, forming an elongated substantially planar board. The planform or outline can be of any suitable configuration. Since many skateboards can be ridden in either direction, it should be understood that the terms front and rear are for descriptive purposes only. The opposite ends of the board are supported on conventional skateboard trucks 16 and 18, with resiliently mounted, self-centering wheels 20 and 22, respectively. The wheel support of each truck is pivotal about an axis inclined to the plane of the board to provide the well known steering action when the board is tilted. Many different truck designs are available and most are suitable for the articulated board.

The separation of the front and rear sections is shown as being at the center of the length of the board, but could be offset toward either end to suit particular riding conditions. At the junction, front section 12 has a downwardly extending flange or end wall 24, and rear section 14 has a similar end wall 26. The end walls abutt at a common transverse flat face 28 and are secured together by a pivot pin 30 spaced below the board. In this instance the pivot pin is shown as being a bolt secured by a lock nut 32, by which a controlled clamping and frictional engagement between the end wall can be maintained. It is necessary for the two sections to pivot readily under foot pressure, but not to be too freely movable without intentional control. Washers 34 are used under nut 32 and bolt head 36 to prevent binding.

As illustrated, the board structure is sectional for plastic material, the end walls being molded integrally with their respective board sections and having suitable reinforcing gussets 38. However, the particular structure will depend on the materials used.

Figure 2:
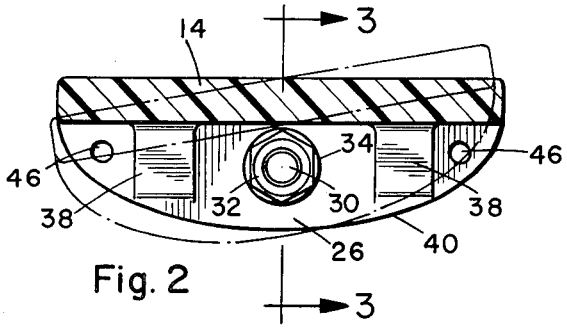
FIG. 2 is an enlarged sectional view taken on line 2—2 of FIG. 1.
Figure 3:
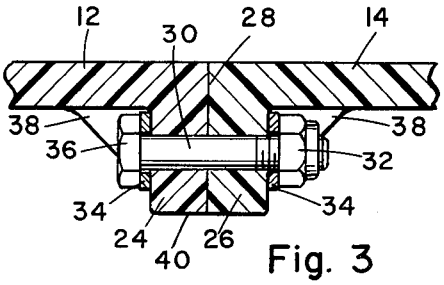
FIG. 3 is a sectional view taken on line 3—3 of FIG. 2.

As shown in FIG. 2, the end walls extend the full width of the board and the edges 40 are smoothly curved downwardly from both sides. In extreme tilted positions of the board sections, this will prevent the rider's toes from being caught between the sections.

Expert skateboard riders are capable of doing hand stands on the board. To facilitate control of the articulated board, the ends of sections 12 and 14 are provided with raised gripping ribs 42 and 44, respectively. Since it may be desirable to use the skateboard in a conventional or rigid manner at times, the end walls 24 and 26 are provided with matching locking holes 46, to receive any suitable locking pins or bolts, not shown.

Figure 4:
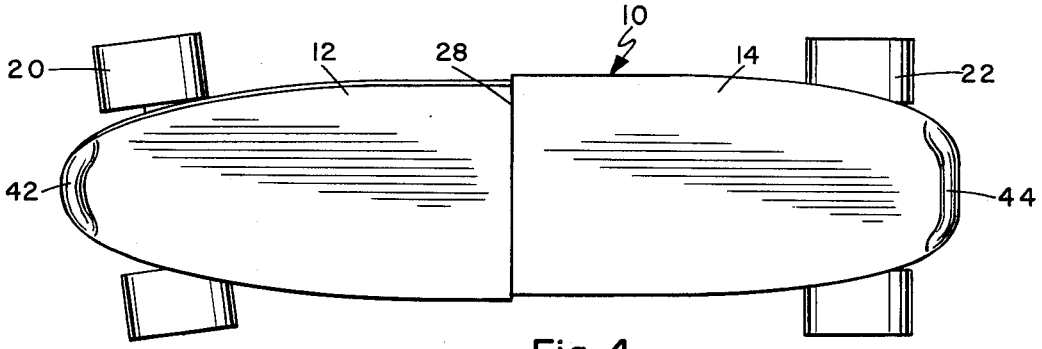
FIG. 4 is a top plan view of the board with one section tilted.

When one section of the board is tilted by the rider's foot, such as the front section 12 in FIG. 4, the wheels 20 are turned by the action. Alternate tilting action by one or both feet will enable the rider to follow a very tight slalom type course, the control being positive and simple to achieve with a minimum of body movement.

Figure 5:
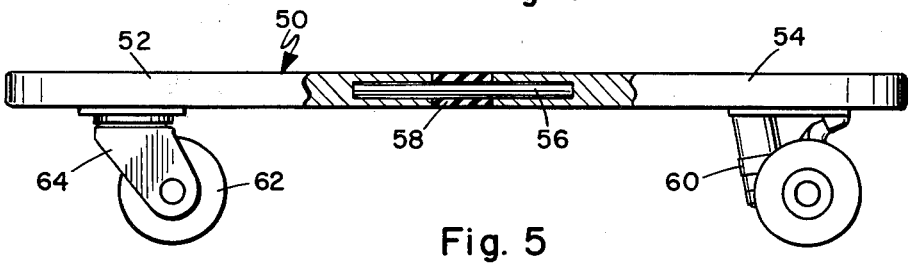
FIG. 5 is a side elevation view, partially cut away, of a board with an alternative pivotal arrangement.

In the configuration illustrated in FIG. 5, the skateboard 50 has sections 52 and 54 joined by a pivot pin 56 contained in the thickness of the board. The sections are joined by an elastomeric connector 58 securely bonded to the confronting ends of the sections and enclosing the pivot pin 56. This provides a resilient self-centering connection which will accommodate the necessary differential tilting action of the sections.

As shown, rear section 54 has a conventional skateboard truck 60, while front section 52 is fitted with a wheel 62 on a castering mounting 64. This arrangement provides very rapid steering response and may be desirable for some purposes.

Figure 6:
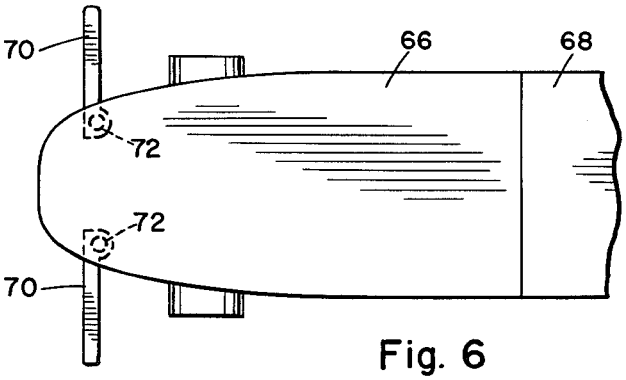
FIG. 6 is a partial top plan view of a board with foldable handlebars.

The structure illustrated in FIG. 6 is adaptable to a large board on which the rider is prone or in a kneeling position. Front section 66 is coupled to rear section 68 in either manner described above. Near the forward end are handlebars 70 mounted on pivots 72 in or below the board, to swing out on opposite sides of the board. The rider can grip the handlebars and apply a powerful tilting action to the front section 66 for steering. When not in use the handlebars can be retracted under or into the board.

Figure 7:
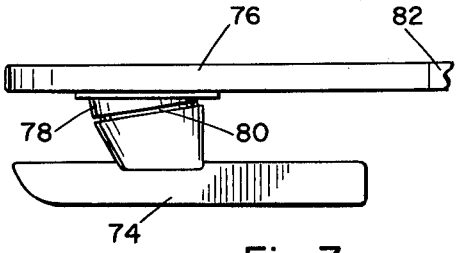
FIG. 7 is a side elevation view of one end of a board with an ice skate type support.

The skateboard can also be used on ice, as in the configuration of FIG. 7. A blade 74 is secured below front section 76 on a mounting 78, with a bearing 80 inclined to the plane of the board to provide the necessary steering action. Rear sections 82 would be supported in a similar manner. Other surface travelling means, such as multiple or ball rollers, tracks, or the like may also be used for specific purposes.

It will be evident that the articulated skateboard is adaptable to a variety of uses and riding techniques. It is easy to ride and the performance is limited only by the skill of the rider.

Having described my invention, I now claim:

1. An articulated skateboard, comprising:

an elongated, substantially planar board having a rider supporting upper surface, the board being transversely divided into a front section and a rear section;

said front and rear sections having downwardly extending confronting end walls having a common contact face, the end walls extending the full width of the board and having edges curving smoothly downwardly from both sides of the board;

a pivot pin extending through said end walls on a longitudinal axis and pivotally interconnecting said front and rear sections;

and surface travelling supporting means mounted under opposite end portions of the board.

2. A skateboard according to claim 1, wherein said walls have corresponding holes therethrough for receiving locking means to lock the front and rear sections against relative movement.

3. An articulated skateboard comprising:

an elongated, substantially planar board having a rider supporting upper surface, the board being transversely divided into a front section and rear section;

a pivot pin interconnecting said front and rear sections on a longitudinal axis, said pivot pin being contained substantially within the thickness of the board;

and surface travelling supporting means mounted under opposite end portions of the board.

4. A skateboard according to claim 3 and including an elastomeric connector joining the confronting ends of said front and rear sections, said connector enclosing said pivot pin.

* * * * *